US005603997A

United States Patent [19]

Lindgren et al.

[11] Patent Number: 5,603,997

[45] Date of Patent: Feb. 18, 1997

[54] PACKAGING MATERIAL PROCESS FOR PRODUCING SAME AND USE THEREOF

[75] Inventors: Erik Lindgren, Bohus; Kenneth Larsson, Göteborg; Signar Sundstrand, Stenungsund; Anna Andersson, Göteborg, all of Sweden

[73] Assignee: Nobel AB, Bohus, Sweden

[21] Appl. No.: 312,971

[22] Filed: Sep. 30, 1994

Related U.S. Application Data

[63] Continuation of Ser. No. 967,452, Oct. 28, 1992, abandoned.

[30] Foreign Application Priority Data

Oct. 28, 1991 [SE] Sweden ..... 9103139

[51] Int. Cl.[6] ..... B65D 30/00

[52] U.S. Cl. ..... 428/34.2; 428/34.3; 428/913; 206/524.1; 206/524.4; 206/828; 229/87.01; 229/87.08; 229/87.14; 229/3.5 R; 426/106; 426/129; 426/130

[58] Field of Search ..... 428/34.2, 34.3, 428/283, 913; 423/327.1; 206/524.1, 524.4, 828; 229/87.01, 87.08, 87.14, 3.5 R; 426/106, 129, 130

[56] References Cited

U.S. PATENT DOCUMENTS

| | | | |
|---|---|---|---|
| 3,702,886 | 11/1972 | Argauer et al. | 423/328 |
| 4,061,724 | 12/1977 | Grose et al. | 423/335 |
| 4,525,410 | 6/1985 | Hagiwara et al. | 428/198 |
| 4,795,482 | 1/1989 | Gioffre et al. | 55/75 |
| 5,126,174 | 6/1992 | Courtright et al. | 428/34.3 |
| 5,161,686 | 11/1992 | Weber et al. | 206/440 |

FOREIGN PATENT DOCUMENTS

| | | |
|---|---|---|
| 0297543 | 1/1989 | European Pat. Off. . |
| 61-70098 | 4/1986 | Japan . |
| 2235740 | 9/1990 | Japan . |
| 8006410 | 4/1982 | Sweden . |
| 678636 | 10/1991 | Switzerland . |
| 2014970 | 9/1979 | United Kingdom . |

OTHER PUBLICATIONS

English Translation of AN 77–529794, Derwent Publications Ltd., London, GB; & JP–A–52 070 200 (IMAGAWA) 10 Jun. 1977.

AN 90–105014, Derwent Publications Ltd., London, GB & JP–A–2 057 572 (OTA) 27 Feb. 1990 (Abstract).

Donald W. Breck, "Zeolite Molecular Sieves", Structure, Chemistry, and Use, J. Wiley & Sons, Jul. 1973.

Peter A. Jacobs et al, "Synthesis of High–Silica Aluminosilicate Zeolites", Studies in Surface Science and Catalysis, vol. 33, 1987.

H. van Bekkum (Editors), "Introduction to Zeolite Science and Practice", Studies in Surface Science and Catalysis, vol. 58, 1991.

Abstract of JP 61–70098.

Abstract of JP 2–235740.

*Primary Examiner*—James J. Seidleck
*Assistant Examiner*—Michael A. Williamson
*Attorney, Agent, or Firm*—Leydig, Voit & Mayer

[57] ABSTRACT

The present invention relates to a packaging material for reduced transfer from a package to its content of substances causing undesirable taste and/or hazardous substances, this reduction being due to the packaging material containing a hydrophobic zeolite. More specifically, the invention concerns paperboard, in which case the substances causing undesirable taste mainly are naturally occurring extractive substances, oxidation products thereof and, to a lesser extent, the paper chemicals present. Further, the presence of a hydrophobic zeolite in the paperboard enhances the water-repellent (hydrophobic) capacity. Also, the present invention concerns a method for production of a packaging material of paper, board or paperboard by forming and dewatering a suspension of lignocellulose-containing fibres, where the dewatering takes place in the presence of a hydrophobic zeolite. Moreover, the present invention relates to the use of a hydrophobic zeolite for production of a packaging material, as well as the use of the thus-produced packaging material in packages for solid or liquid foodstuff, tobacco or medicines.

14 Claims, No Drawings

PACKAGING MATERIAL PROCESS FOR PRODUCING SAME AND USE THEREOF

This application is a continuation of application Ser. No. 07/967,452, filed Oct. 28, 1992, now abandoned.

The present invention relates to a packaging material for reduced transfer from a package to its content of substances causing undesirable taste and/or hazardous substances, this reduction being due to the packaging material containing a hydrophobic zeolite. In packaging materials of paper, board, paperboard or plastic, the substances causing undesirable taste are primarily aldehydes and ketones. Hazardous substances, such as chlorinated organic compounds, may sometimes also be present in such packaging materials. More specifically, the invention concerns paperboard for solid or liquid foodstuff, tobacco or medicines, in which case the substances causing undesirable taste mainly are naturally occurring extractive substances, oxidation products thereof and, to a lesser extent, the paper chemicals present. The reduced transfer of substances causing undesirable taste in paperboard may be obtained by adsorption on the zeolite surface of the substances causing undesirable taste, and/or by reduction of the autoxidation of the unsaturated fatty acids and triglycerides present. Further, the presence of a hydrophobic zeolite in the paperboard enhances the water-repellent (hydrophobic) capacity. Also, the present invention concerns a method for production of a packaging material of paper, board or paperboard by forming and dewatering a suspension of lignocellulose-containing fibres, where the dewatering takes place in the presence of a hydrophobic zeolite.

BACKGROUND OF THE INVENTION

Packages are used to enclose the content during storage and transport, to protect the content so as to keep their qualities from filling until emptying of the package, and often also to market the content. It has proved especially difficult to design packages for maintaining the original properties of contents, such as foodstuff, medicine or cigarettes. The quality of the content may be reduced either by the content itself changing as time goes on or by quality-reducing substances being supplied from or through the package. The content can be treated, e.g. pasteurized, as with milk; or dried, as with flour. Usually, the packages are designed with several layers which often are made of different materials. Thus, each layer and each material has a specific quality and purpose in the package, such as preventing the transfer of oxygen, water or water vapour to the foodstuff.

Packaging materials are much used as components in packages to keep solid foodstuff or liquid foodstuff, such as milk, juice, wine and water. Packages for beverages usually are made of rigid paperboard comprising several different layers of lignocellulose-containing fibres, combined with one or more layers of plastic in direct contact with the beverage. Despite the use of such specially designed combinations of materials, the beverages usually acquire an undesirable taste after some time. It has been found that the substances causing undesirable taste in the beverage often are oxidation products formed during production and storage of the paperboard. Since the packaging material is kept on rolls or in bales of sheets before the finished packages have been shaped and filled with food, the oxidation products may be transferred to the plastic-coated inside of the package. Thus, it is desirable to reduce not only the formation of substances causing undesirable taste in the production of packaging materials, but also the transfer of substances causing undesirable taste present in the packaging material from the start or formed during its production.

SE patent specification 8006410-8 discloses the pretreatment of a box blank subjected to neutral or alkaline sizing in order to reduce the formation of such degradation products as aldehydes and ketones formed by autoxidation. Thus, chips and/or the mechanical pulp produced from the chips are treated with alkali and subsequently washed or dewatered in one or several steps. Naturally, more process steps make the process more complicated as well as more expensive. Also, the process does not solve the problems associated with other substances causing undesirable taste than those present in the chips. Thus, an addition of paper chemicals, such as retention agents, dewatering agents and sizing agents, may increase the problem of undesirable taste of the food.

SUMMARY OF THE INVENTION

The invention provides a packaging material enabling a reduction or complete elimination of the transfer from a package to its content of substances causing undesirable taste, and/or hazardous substances owing to the packaging material containing a hydrophobic zeolite. This makes it possible to lower the requirements on the structure and material of the package and/or considerably restrict the deterioration of the taste of the package content.

Thus, the invention concerns a packaging material for reduced transfer from a package to its content of substances causing undesirable taste and/or hazardous substances, this reduction being due to the packaging material containing a hydrophobic zeolite. The invention further concerns a method for production of a packaging material of paper, board or paperboard by forming and dewatering a suspension of lignocellulose-containing fibres in the presence of a hydrophobic zeolite.

In addition, the invention relates to the use of a hydrophobic zeolite for production of a packaging material and the use of a packaging material containing a hydrophobic zeolite in packages for solid or liquid foodstuff, tobacco or medicines.

As indicated above, it is known to treat with alkali chips and/or pulp intended for liquid carton board which has been subjected to neutral or alkaline sizing. Although such treatment reduces the formation of oxidation products in the lignocellulose, it does not prevent the transfer of substances causing undesirable taste which may be supplied to the packaging material at any stage up to the filling of the finished package. With the inventive packaging material containing a hydrophobic zeolite, it has been found possible to reduce or completely prevent transfer from a package to its content of substances causing undesirable taste, especially when the packaging material is made up of one or more layers of paper, board, paperboard or plastic, or combinations thereof. The method according to the present invention makes it possible to use less expensive raw materials, such as recycled fibres, in the production of the package, or to reduce the number of layers of paper or plastic in the packaging material without increasing the experience of undesirable taste. Further, it is possible to augment the use of paper chemicals which, for one reason or another, improve the paper or facilitate papermaking but which have not been fully utilized previously owing to the undesirable taste imparted by the finished package. If the raw materials and structure of the packaging material are instead kept unchanged, the presence of a hydrophobic zeolite will improve the quality of the content. This is especially applicable to foodstuff, tobacco or medicine stored for a long period of time.

Beverage bottles of polyester are an example of packaging material of plastic where substances causing undesirable taste may be present. Usually, the bottles are made by blow moulding, which may result in the formation of acetaldehyde. Also in extremely small amounts, acetaldehyde may ruin the taste of beverages containing carbon dioxide. The presence of a hydrophobic zeolite can, however, reduce the amount of substances causing undesirable taste formed during blow moulding and/or the amount of such substances transferred from the finished polyester bottle to its content.

The packaging material according to the present invention and the method for production thereof enable a reduced transfer from a package to its content of substances causing undesirable taste as well as hazardous substances. Hazardous substances include chlorinated organic compounds, such as dioxins and furans, which may be formed in bleaching of chemical fibres involving large amounts of elemental chlorine. Although the present invention reduces the transfer of substances causing undesirable taste as well as hazardous substances, the present invention will in the following be described with reference to the reduction of substances causing undesirable taste.

Packages may be flexible, semi-rigid or rigid and be made of such packaging materials as paper, board, paperboard, plastic, aluminium foil and textile fabric, or combinations thereof. In the present invention, the packaging material suitably is paper, board, paperboard or plastic, or a combination thereof. Preferably, the packaging material is paper, board or paperboard, since the reduction in transfer of substances causing undesirable taste is more limited in plastics due to clogging of the pores. More preferably, the packaging material is paperboard, optionally coated with one or more layers of plastic.

In the present invention, plastic relates to plastic foil, plastic film, plastic-film laminate, and hollow articles of thermoplastic. These plastics may also contain additives, such as stabilizers, lubricants, fillers, pigments and plasticizers, or undesirable components, such as residual monomers. When heated, the plastics themselves can be oxidized to substances causing undesirable taste, such as aldehydes and ketones. Also such components as stabilizers which consist of heavy-metal compounds or residual monomers, such as vinyl chloride, may constitute or produce substances causing undesirable taste. Owing to the size of the zeolite particles, the plastic in the present invention suitably is plastic foil, plastic-film laminate or hollow articles of thermoplastic. In a technically simple way, the zeolite particles can be introduced into the comparatively thick foils and hollow articles, but they are placed between or outside the relatively thin plastic layers of the laminates. In these positions, the zeolite particles effectively reduce the transfer of substances causing undesirable taste. Usually, foils for packaging materials consist of thermoplastics, such as polyethylene. The thickness normally is 50–800 μm.

Plastic foils are manufactured by calendering between two or, which is more common, four horizontal rolls in a roll mill. Before a mixture can be supplied to the calender, its components have to be homogenized in an introductory, optionally heated, premixing step, and gelatinized in a subsequent step. The hydrophobic zeolite can be added in the premixing step, suitably in powder form during the introductory stage of this step.

Plastic film is a thin thermoplastic packaging foil having a thickness of about 10 μm. Plastic-film laminates employed as packaging materials normally comprise several combined thermoplastic films. Thermoplastics used for plastic films include polyethylene, polypropene, polyester, polyamide, polyvinyl chloride, polyvinylidene chloride, ionomer film and cellophane. Films of polyethylene and polypropene are suitably used in the present invention.

Plastic films are usually produced by film blowing, in which an extruded hose is blown up in a die, cooled, pulled off between two nip rolls and rolled up round a roll. This method results in a thin film of good mechanical strength, both in the longitudinal and the transverse direction. Plastic-film laminates are usually manufactured by coating by slot-die extrusion (extrusion coating) or binder lamination. These methods are commonly used when one or more layers of plastic film of one or several materials are laminated with paper, paperboard and/or aluminium foil. In extrusion coating, the plastic is melted in an extruder and fed out under high pressure through a slot die onto the web to be coated. Paper and paperboard are usually coated by extrusion with polyethylene or polypropene when an improved heat resistance is desired. Before being coated with the plastic layers, the web of paper or paperboard may be coated with one or more other components by spraying of a dry or humid powder or coating with a viscous or semi-viscous paste. Also the outermost plastic layer of the laminate may be thus coated with one or more other components. In binder lamination, two or more webs of material are laminated with a polyurethane-type glue. In the production of plastic-film laminates, also glue doubling and wax and hot-melt lamination are used. Plastic-film laminates may also be produced by film blowing or film moulding on a cooled roll, the laminate being coextruded through two or more extruders connected to the same blow die and flat die, respectively. According to the present invention, a plastic laminate made up of a combination of plastic and paper, board, paperboard or plastic, is suitably produced by extrusion coating or binder lamination. Further, it is suitable that the hydrophobic zeolite is applied to the web of paper, board, paperboard or plastic before coating with plastic layers.

Blow moulding is the most common method for production of hollow articles of thermoplastic, but also thermoforming and rotational casting are used for moulding large or very large hollow articles. In blow moulding, a heated and plastic substance is blown from an extruder by means of compressed air up against the walls of a cooled mould which has been closed about the blank. When the blown article has cooled off sufficiently, the mould is opened and the article removed. Blow moulding is suitable for hollow articles of volumes ranging from about 1 $cm^3$ up to about 5 $m^3$. Important blow-moulded hollow articles include bottles, tubes or ampoules intended for foodstuff, such as vinegar, cooking oil, milk or lemonade, as well as packages for medicine. The thermoplastic employed may be polyethylene, polypropene, polyester, polystyrene, polyvinyl chloride and polyamide. The hydrophobic zeolite can be added to the polymer in the form of a dry powder before the polymer mixture reaches the extruder. The zeolite may also be introduced between layers of the same or different thermoplastics in laminated hollow articles by being supplied on the inside of the cooled mould or in the die in connection with the blowing. It is especially suitable to coat a carrier material of an inexpensive thermoplastic with zeolite which then will be coated on the outside and/or the inside with one or more materials of higher density, such as polyamide. With such laminated hollow articles, glass bottles for foodstuff may in many cases be replaced with plastic bottles.

The sensation of undesirable taste is a subjective phenomenon related to the total content of oxidation products formed. Autoxidation of the unsaturated fatty acids naturally occurring in wood primarily results in the formation of aldehydes and ketones. For these groups of chemical compounds, it has been found to exist a fair correspondence between people's sensation of taste and the measured content of n-hexanal only. Therefore, determination of the amount of substances causing undesirable taste being transferred from packaging material primarily of paper, board and paperboard can be much simplified to comprise an analysis of n-hexanal only.

Zeolites are inorganic crystalline compounds mainly consisting of $SiO_2$ and $Al_2O_3$ in tetrahedral coordination. In the present invention, zeolites also relate to other crystalline compounds of zeolite structure, such as aluminium phosphates. Such crystalline compounds of zeolite structure which can be used in the present invention are defined in W. M. Meier et al, Atlas of zeolite structure types, sec. ed., Butterworths, London, 1987, which is hereby incorporated by reference in the present application. Many zeolites occur naturally, but most commercially used zeolites are synthetically produced. These zeolites function as adsorbents or molecular sieves and may, depending on the size of the cavities and the nature of the zeolite surface, be used to increase or decrease the taking-up of specific chemical compounds. In the present invention, a very essential property of the zeolites is a limited capacity to take up water. Such a hydrophobic (water-repellent) nature also involves an increased capacity to attach non-polar compounds among which the organic substances constitute the largest group. Zeolites able to attach, inter alia, aldehydes and ketones and thus the most important substances causing undesirable taste, are primarily zeolites with a high molar ratio of $SiO_2$ to $Al_2O_3$ in tetrahedral coordination. Zeolites having such a high molar ratio can be produced by letting the synthesis take place under conditions giving a higher silicon content in the zeolite and/or by removing aluminium from the structure. Finally, the structure is stabilized by thermal treatment, whereby a decreased capacity for taking up water is obtained. In the present invention, it is important that the molar ratio of $SiO_2$ to $Al_2O_3$ in tetrahedral coordination is at least about 10:1. Suitably, the molar ratio lies in the range of from 15:1 up to 1000:1, preferably in the range of from 20:1 up to 300:1. It is especially preferred that the molar ratio of $SiO_2$ to $Al_2O_3$ in tetrahedral coordination lies in the range of from 25:1 up to 50:1.

In most zeolites, the water-repellent capacity can be modified to a certain extent by different surface treatments, such as heating in ammonia atmosphere, water vapour or air. Such surface modifications of zeolites are described in more detail in D. W. Breck, Zeolite molecular sieves: structure, chemistry, and use, John wiley & Sons, New York, 1974, pp 507–523, and H. van Bekkum et al, Introduction to zeolite science and practice, Elsevier, Amsterdam, 1991, pp 153–155, which are hereby incorporated by reference in the present application. The hydrophobicity of the zeolite after such treatments can be determined by the so-called Residual Butanol Test, described in GB patent specification 2,014,970. In this test, the zeolite is activated by being heated in air at 300° C. for 16 h. Then, 10 parts by weight of the thus-activated zeolite is mixed with a solution consisting of 1 part by weight of 1-butanol and 100 parts by weight of water. The resulting slurry is agitated slowly for 16 h at 25° C. Finally, the residual content of 1-butanol in the solution is determined and the result given in percent by weight. A low value thus means a high degree of hydrophobicity. In the present invention, the hydrophobicity, as characterized by the residual butanol content, is suitably below about 0.6% by weight. Preferably, the residual butanol content lies in the range of from 0.0001% by weight up to 0.5% by weight, and it is especially preferred that the residual butanol content lies in the range of from 0.0002% by weight up to 0.3% by weight.

Zeolites exhibiting a high degree of hydrophobicity, optionally after certain modification, and therefore capable of sufficiently reducing the transfer from the package to its content of substances causing undesirable taste in accordance with the present invention, are zeolites of the pentasil type, faujasite type, mordenite, erionite and zeolite L. The preparation of pentasil-type zeolites is described in U.S. patent specifications 3,702,886 and 4,061,724, which are hereby incorporated by reference in the present application. Suitably, the hydrophobic zeolites are of the pentasil type, since this gives a considerable reduction of the transfer of substances present which cause undesirable taste. Simultaneously, the pentasil type zeolites close to eliminate the formation of autoxidation products causing undesirable taste, e.g. when drying paper, board, or paperboard. Zeolites of the pentasil type include ZSM-5, ZSM-11, ZSM-8, ZETA-1, ZETA-3, NU-4, NU-5, ZBM-10, TRS, MB-28, Ultrazet, TsVKs, TZ-01, TZ-02 and AZ-1. Suitably, the zeolite of pentasil type is ZSM-5 or ZSM-11, preferably ZSM-5. The zeolites ZSM-5 and ZSM-11 are defined by P. A. Jacobs et al, Synthesis of high-silica aluminosilicate zeolites, Studies in surface science and catalysis, vol. 33, Elsevier, Amsterdam, 1987, pp 167–176, which is hereby incorporated by reference in the present application.

The amount of zeolite added may vary within wide limits. Thus, the amount of zeolite added may be up to 100 kg/ton of dry packaging material and e.g. lie in the range of from 8 kg/ton up to 100 kg/ton of dry packaging material. Suitably, the amount of zeolite added lies in the range of from about 0.05 kg/ton up to about 20 kg/ton of dry packaging material. Preferably, the amount of zeolite lies in the range of from 0.1 kg/ton up to 15 kg/ton of dry packaging material, more preferably in the range of from 0.2 kg/ton up to 10 kg/ton of dry packaging material.

A considerable reduction of the transfer of substances causing undesirable taste requires a well-dispersed hydrophobic zeolite. This is achieved, inter alia, if the particles are small, so as to penetrate the whole portion of the packaging material to which they have been added. Suitably, the particle size of the zeolite is less than about 20 μm, and preferably lies in the range of from 0.1 μm up to 15 μm.

The method according to the present invention preferably relates to the production of a packaging material of paper, board or paperboard, in which the paper, board or paperboard is produced by forming and dewatering a suspension of lignocellulose-containing fibres in the presence of a hydrophobic zeolite. Thus, the packaging material, which is of paper, board or paperboard, is preferably made in accordance with the so-called wet process, and the zeolite is preferably added before the head box of the papermaking machine. The hydrophobic zeolite may be added to the stock in the form of a slurry with or without stabilizing agents, in the form of a dry powder supplied by means of a screw conveyor, or in the form of a mixture containing paper chemicals, such as retention agents or inorganic colloids. When a dispersion of conventional sizing agents, such as alkyl ketene dimers and/or alkenyl succinic anhydrides, is also added to the stock, the zeolite can be admixed to the dispersion before this is added to the stock. However, the method according to the present invention, also comprises the addition of the zeolite at later stages of the papermaking process. In the production of paperboard, for instance, a slurry containing the zeolite may be sprayed onto one or more lignocellulose-containing layers which layers are then couched together. Also, the zeolite can be introduced into the paper in layers not containing any lignocellulose-containing fibres. Such layers may be found between lignocellulose-containing layers or on the surface of the paper structure. Examples of the latter are coating slips.

Packaging materials of paper, board or paperboard often come into contact with liquids, either intentionally or unintentionally. The liquids have a tendency to disintegrate the paper structure, especially from the unprotected edge. When a hydrophobic zeolite is present during forming and dewatering of the paper, the hydrophobic (water-repellent) nature of the packaging material is enhanced. This reduces the liquid-penetration velocity, especially as regards liquid penetration from the edge of the paper.

Paper, board or paperboard according to the present invention may contain also other paper chemicals known to be used in papermaking. Paper chemicals intended to give the paper a specific final property are called function chemicals, whereas the chemicals intended to improve production efficiency are called process chemicals. Naturally, primarily the function chemicals will form part of the finished paper, but also some process chemicals leave the process in the paper. Function chemicals include sizing agents, dry strength agents, wet strength agents, pigments, fillers, colouring agents and fluorescent whitening agents. Amongst these agents, the chemically active sizing agents and dry strength and wet strength agents normally increase the presence of substances causing undesirable taste. Process chemicals include retention agents, dewatering agents, defoamers, slime controlling agents as well as felt and wire detergents. Amongst these agents, at least the retention and dewatering agents normally increase the presence of substances causing undesirable taste.

To increase the yield of addition of the zeolite, forming and dewatering suitably take place in the presence of a retention agent. However, the addition of a retention agent may increase the transfer of substances causing undesirable taste, yielding a poorer result than with pulp only. This is due to the improved retention of fine fibres or other fine fractions containing higher contents of substances causing undesirable taste than do the larger and longer fibres. Surprisingly enough, it has been found that the combination of retention agent and zeolite according to the present invention results in a lower transfer of substances causing undesirable taste than the corresponding amount of zeolite only. This effect is evident from Example 2.

Retention agents are previously known in papermaking. Suitable compounds include polysaccharides, such as starch, cellulose derivatives and guar gum, or synthetically prepared homopolymers, such as polyacryl amide (PAM), polyamide amine (PAA), polydiallyl dimethyl ammonium chloride (poly-DADMAC), polyethylene imine (PEI) and polyethylene oxide (PEO), or copolymers thereof. The cationic and anionic nature of the retention agents are enhanced by the introduction of nitrogen-containing groups or covalently bound phosphor groups, respectively. Methods for the introduction of such groups are well-known to the expert. In the method according to the present invention, it has been found especially suitable to use cationic retention agents, such as starch, PAM and PEI, or combinations thereof, since this results, inter alia, in a high retention.

The amount of retention agent added may lie in the range of from about 0.01 kg/ton up to about 20 kg/ton, based on dry fibres and optional paper chemicals. Suitably, this amount lies in the range of from 0.02 kg/ton up to 10 kg/ton, based on dry fibres and optional paper chemicals.

When a retention agent is used together with a hydrophobic zeolite, the order of addition is optional. A good effect in the reduction of undesirable taste is also obtained if the retention agent and zeolite are mixed before being added to the fibrous suspension.

In the production of packaging material of paper, board or paperboard according to the invention, retention and dewatering can be enhanced by the presence of anionic or cationic inorganic colloids which have been used previously in papermaking. The colloids are added in the form of dispersions (sols) which do not settle due to the large ratio of surface to volume. Suitably, these colloidal inorganic particles have a specific surface area exceeding about 50 $m^2/g$. Anionic inorganic colloids include bentonite, montmorillonite, titanyl sulphate sols, aluminium oxide sols, silica sols, aluminium-modified silica sols and aluminium silicate sols. Suitably, the inorganic colloids used are silica-based sols. Preferably, the silica-based sols have at least one surface layer containing aluminium, whereby the sols become resistant within the whole pH range that can be used in the method according to the present invention. Suitable sols may also be based on polysilicic acid, which means that the silicic acid is in the form of very small particles having a very large specific surface. Commercially available silica-based sols suitably used in the present invention, are produced and marketed, inter alia, by Eka Nobel AB in Sweden.

In the production of packaging material according to the invention, retention and dewatering may be further enhanced by the presence of one or more aluminium compounds which are previously known in papermaking. Suitable aluminium compounds in the present invention are such compounds that can be hydrolysed to cationic aluminium hydroxide complexes in the fibrous suspension. The improved retention and dewatering are then achieved by the interaction with anionic groups on the fibres and of other paper chemicals. In fibrous suspensions having a pH below about 7 before addition, it is especially suitable to use aluminates as the aluminium compound, such as sodium aluminate or potassium aluminate. In fibrous suspensions having a pH above about 7 before addition, suitable aluminium compounds include alum, aluminium chloride, aluminium nitrate and polyaluminium compounds. Preferably, use is made of polyaluminium compounds since such compounds show an especially strong and stable cationic charge in this higher pH range. Ekoflock, produced and marketed by Eka Nobel AB in Sweden, is one example of a commercially available polyaluminium compound.

In the production of a packaging material of paper, board or paperboard, the hydrophobic effect of the material can be enhanced by the presence of conventional sizing agents. Such agents may be divided into fortified or unfortified resins, wax dispersions, sodium stearate and fluorine-based and cellulose-reactive sizing agents. According to the present invention, it has been found suitable to use cellulose-reactive sizing agents, since such agents are covalently, and thus more strongly, bound to the cellulose fibres than other sizing agents. Preferably, use is made of alkyl ketene dimers (AKD), alkenyl succinic anhydrides (ASA) or combinations thereof, since this renders the packaging material particularly repellent to aggressive liquids. In the production of AKD, use is made of saturated fatty acids which, however, contain portions of unsaturated fatty acids. Like the unsaturated fatty acids occurring naturally in the wood, the supplied unsaturated fatty acids can be oxidized by heating e.g. in the drying section, resulting in the formation of substances causing undesirable taste, such as aldehydes and ketones. The presence of a hydrophobic zeolite counteracts such oxidation, while enhancing the sizing effect. It is therefore especially preferred to use AKD as sizing agent in the present invention. According to the present invention, AKD is suitably used in liquid carton board to give resistance to lactic acid as well as reduced transfer of substances causing undesirable taste.

The various paper chemicals are added in amounts, in positions, during residence times and in an order well-known to the expert.

In the production of paper, board and paperboard, the preferred pH in the suspension of lignocellulose-containing fibres and optional paper chemicals, may vary within wide limits. With the method according to the present invention, the zeolite particles reducing the undesirable taste can be added within a very broad pH range, since the zeolite particles are crystalline and thus of an inert nature. A good effect is thus obtained when the pH of the fibrous suspension before dewatering lies in the range of from about 3.0 up to about 10.0. Suitably, the suspension has a pH before dewatering lying in the range of from 3.5 up to 9.5, preferably in the range of from 4.0 up to 9.0.

The zeolite added reduces not only the formation and transfer of substances causing undesirable taste, but also the content of dissolved material in the recirculating water (white water) used for suspending the lignocellulose-containing fibres and the paper chemicals. The material dissolved in the white water can be adsorbed on the zeolite surface, which reduces the content thereof in the white water. The material from the white water adsorbed on the zeolite surface leaves the manufacturing process via the formed and dewatered paper. This increases the transfer from the finished packaging material of substances causing undesirable taste, since the adsorbed material contains comparatively high contents of substances causing undesirable taste, such as aldehydes and ketones. The presence of the hydrophobic zeolite does, however, give a lower increase than would the sole presence of the material from the white water. Thus, the flexibility in papermaking is increased, since the white water may be wholly or partly purified if the transfer from the finished packaging material of substances causing undesirable taste may be allowed to increase.

The time for the addition of zeolite is of decisive importance to the degree of purification of the white water. The longer the hydrophobic zeolite stays in the suspension of lignocellulose-containing fibres and optional paper chemicals, the larger the amount of dissolved chemical substances adsorbed on the surface of the zeolite particles. To obtain a maximum reduction in the transfer of substances causing undesirable taste according to the invention, the zeolite is suitably added less than about 20 min before forming and dewatering the suspension of lignocellulose-containing fibres. Preferably, the zeolite is added less than 5 min before forming and dewatering the suspension. Furthermore, the zeolite is suitably added in the machine chest or in the pipe system running from said chest towards the head box in connection with pumping, deaeration or screening. Preferably, the zeolite is added immediately before the head box of the papermaking machine, e.g. at the fan pump where vigorous agitation takes place.

According to the present invention, a hydrophobic zeolite is suitably used for producing packaging material. Suitably, the hydrophobic zeolite is of the pentasil type, preferably ZSM-5. The packaging material is made up of one or more layers of paper, board, paperboard or plastic, or combinations thereof. Preferably, the hydrophobic zeolite is used for producing a packaging material of paperboard, optionally coated with one or more plastic layers. Packaging materials containing a hydrophobic zeolite are suitably used in packages for solid or liquid foodstuff, tobacco or medicines. Paperboard for solid foodstuff include confectionery carton board, specifically chocolate carton board. Packaging materials containing a hydrophobic zeolite are preferably used in packages for liquid foodstuff, such as milk, juice, wine or water.

In the present invention, paper relates to web- or sheet-shaped products of randomly distributed lignocellulose-containing fibres, which may also contain chemically active or fairly passive paper chemicals. In the present invention, paper relates to paper, board as well as paperboard. Paperboard is a flexurally rigid paper or thin board consisting of one or more layers of lignocellulose-containing fibres which have been pressed together under wet conditions. The paperboard layers may consist of similar fibres or, which is more common, of low-quality fibres in the inner layers and high-quality fibres in the surface layers. Low-quality fibres here relate to mechanically produced fibres or recycled fibres, whereas high-quality fibres relate to chemically produced fibres. In liquid carton board, for instance, it is common with a central layer of chemi-thermomechanical pulp (CTMP), whereas the top and bottom layers consist of bleached or unbleached sulphate pulp.

Lignocellulose-containing fibres relate to fibres of hardwood and/or softwood which have been separated by chemical and/or mechanical treatment, or recycled fibres. The fibres may also be separated by modifications of the above chemical and mechanical processes. Suitably, the fibres are separated by mechanical treatment or are recycled fibres, since the content of substances causing undesirable taste increases with the lignin content and by ageing. Thus, such fibres result in more pronounced improvements as to the reduction of the formation and transfer of substances causing undesirable taste than do the comparatively purer chemical pulps. It is especially suitable to employ virgin fibres separated by mechanical treatment, and especially preferred to employ fibres separated in a disc refiner.

The invention and its advantages will be illustrated in more detail by the following Examples which, however, are only intended to illustrate the invention without limiting the same. The parts and percentages stated in the description, claims and Examples, relate to parts by weight and percent by weight, respectively, unless otherwise stated.

The determination of the amount of substances causing undesirable taste transferred from packaging materials of paper or pulp may, as indicated above, be much simplified to comprise an analysis of n-hexanal only. The content of n-hexanal can be determined by the so-called hot method, in which a sample consisting of zeolite and 2.5 g of packaging material is placed in a vessel which then is sealed. After shaking for 5 min and subsequent thermostating at 100° C. for 40 min, an amount of gas above the sample is retrieved and immediately analyzed in a gas chromatograph. Then, the content of n-hexanal in the amount of gas is calculated from the top area of the chromatogram. The degree of undesirable taste is given as the hexanal residue, which constitutes a percentage share of the content of n-hexanal transferred from the sheet or pulp containing zeolite and/or paper chemicals in relation to the corresponding content transferred from the sheet or pulp without additives. Thus, the content of n-hexanal transferred from the sheet or pulp without any addition of zeolite or paper chemicals has been set at 100%.

In Examples 1–4 four different zeolites have been used. Table I shows such properties as their molar ratio of $SiO_2$ to $Al_2O_3$ and the hydrophobicity determined according to the Residual Butanol Test described above. Zeolite C can be described as a mixture in equal parts of ZSM-5 and Zeolite Y.

TABLE I

| Sample No. | Zeolite type | Molar ratio $SiO_2/Al_2O_3$ | Butanol taking-up % by weight |
|---|---|---|---|
| 1 | ZSM-5:280 | 280 | 0.03 |
| 2 | ZSM-5:32 | 32 | 0.14 |
| 3 | Zeolite Y | 25 | 0.24 |
| 4 | Zeolite C | 10 | 0.22 |

In Examples 2 and 3, the retention agent is cationic starch, and the anionic inorganic colloid is a silica-based sol marketed by Eka Nobel AB under the trade name of BMA-0 and having a specific surface of 500 $m^2/g$ and an average particle size of 5 nm.

The conventional sizing agent in Example 3 is alkyl ketene dimers (AKD) having an alkyl ketene dimer content of 14% and a dry content of 18.8%.

EXAMPLE 1

Table II shows the results of tests regarding the reduced transfer of substances causing undesirable taste. In the tests, four different zeolites were added to a pulp mixture consisting of stone groundwood (SGW) and thermomechanical pulp (TMP) in equal parts. For control purposes, tests were also performed on pulp without any addition of zeolite, in which case the hexanal residue was set at 100%. The amount of zeolite added has been recalculated as kg/ton of dry pulp. The properties of the zeolites appear from Table I above.

TABLE II

| Sample No. | Zeolite type | Zeolite amount kg/ton | Hexanal residue % |
|---|---|---|---|
| 1 | — | 0 | 100 |
| 2 | ZSM-5:280 | 1 | 70 |
| 3 | ZSM-5:280 | 5 | 22 |
| 4 | ZSM-5:280 | 10 | 1.3 |
| 5 | ZSM-5:280 | 50 | 0 |
| 6 | ZSM-5:32 | 5 | 15 |
| 7 | ZSM-5:32 | 10 | 1.1 |
| 8 | Zeolite Y | 10 | 28 |
| 9 | Zeolite C | 5 | 21 |
| 10 | Zeolite C | 10 | 1.6 |

It is evident from Table II that the addition of a hydrophobic zeolite reduces the level of undesirable taste compared with the pure pulp in the control sample.

EXAMPLE 2

Table III shows the results of tests regarding the reduced transfer of substances causing undesirable taste. In the tests, Zeolite C was added to a stock containing chemi-thermomechanical pulp (CTMP), and sheets were subsequently made in a Finnish sheet mould. The amount of zeolite added corresponded to 1–100 kg/ton of dry pulp. Tests were also performed, in which Zeolite C was admixed in a combination with 8 kg of cationic starch and 2 kg of anionic silica-based sol per ton of CTMP pulp (Samples 4 and 5). For control purposes, a test was also carried out on pulp without any addition of Zeolite C or paper chemicals (Sample 1), at which the hexanal residue was set at 100%.

TABLE III

| Sample No. | Zeolite kg/ton | Starch kg/ton | Silica-based sol kg/ton | Hexanal residue % | Ash content % |
|---|---|---|---|---|---|
| 1 | 0 | 0 | 0 | 100 | 0.43 |
| 2 | 10 | 0 | 0 | 59 | 0.61 |
| 3 | 100 | 0 | 0 | ≦2.5 | 2.02 |
| 4 | 0 | 8 | 2 | 173 | 0.61 |
| 5 | 10 | 8 | 2 | ≦2.5 | 2.12 |

It appears from the Table that the addition of cationic starch and anionic silica-based sol gives a level of undesirable taste determined as hexanal content which is higher than for sheets made without any paper chemicals present (Sample 4 compared with Sample 1). When zeolite is added, the level of undesirable taste goes down (Sample 5 compared with Sample 4).

EXAMPLE 3

Table IV show s the results of tests regarding the reduced transfer of substances causing undesirable taste. In the tests, 1.5 or 8 kg/ton of pulp of ZSM-5:32 was added to a fibrous suspension of a CTMP pulp. The pulp concentration was 0.5% by weight, and the pH of the fibrous suspension was adjusted to 7.5 by an acid. 5 s after the addition of zeolite, 1 or 3 kg of alkyl ketene dimers was added per ton of pulp, in the form of a 1% solution. Another 10 s later, 8 kg of starch/ton of pulp was added in the form of a 0.5% solution, and 30 s later, 2 kg of silica-based sol/ton of pulp was added, also in the form of a 0.5% solution. After another 15 s, sheets of paper having a grammage of 150 $g/m^2$ were made in a dynamic (French) sheet mould and subsequently dried in a climatic chamber overnight and hardened at 120° C. for 12 min. For control purposes, a test without zeolite and alkyl ketene dimers was also performed (Sample 1), at which the hexanal residue was set at 100%.

TABLE IV

| Sample No. | Zeolite kg/ton | AKD kg/ton | Hexanal residue % | Ash content % |
|---|---|---|---|---|
| 1 | 0 | 0 | 100 | 0.7 |
| 2 | 0 | 1 | 97.4 | 0.7 |
| 3 | 0 | 3 | 166 | 0.7 |
| 4 | 1.5 | 3 | 64.0 | 0.8 |
| 5 | 8.0 | 1 | 21.1 | 1.3 |
| 6 | 8.0 | 3 | 29.8 | 1.4 |

It is evident from the Table that the presence of alkyl ketene dimers increases the amount of substances causing undesirable taste, but this effect is counteracted by the addition of a hydrophobic zeolite.

EXAMPLE 4

Table V shows the results of full-scale tests regarding the effect of storage on the transfer of substances causing undesirable taste. In the tests, ZSM-5:32 was added to a fibrous suspension of a mechanical pulp in an amount of 2 kg/ton of dry sheet. The commercial paperboard produced had a grammage of about 200 $g/m^2$. The produced specimens were stored for 1, 13 and 180 days, before the content of n-hexanal was determined in accordance with the hot method described above. The hexanal residue values are relative. For control purposes, tests without zeolite were also performed (Sample 1, 3, and 5).

TABLE V

| Sample No. | Period of time days | Zeolite kg/ton | Hexanal residue |
|---|---|---|---|
| 1 | 1 | 0 | 1.7 |
| 2 | 1 | 2 | 0.1 |
| 3 | 13 | 0 | 3.5 |
| 4 | 13 | 2 | 0.4 |
| 5 | 180 | 0 | 42 |
| 6 | 180 | 2 | 11 |

It is evident from Table V that the presence of a hydrophobic zeolite in the paperboard, can keep the amount of substances causing undesirable taste at a low level even after storage for a long time.

We claim:

1. A packaging material for forming a package having reduced transfer to the package contents of at least one of substances causing undesirable taste or hazardous substances, wherein said packaging material includes a hydrophobic zeolite having a particle size of less than about 20 μm and a hydrophobicity of below about 0.6 percent by weight residual butanol determined by the Residual Butanol Test.

2. A packaging material according to claim 1, wherein said packaging material is paper or board.

3. A packaging material according to claim 1, wherein the zeolite has a molar ratio of $SiO_2$ to $Al_2O_3$ in tetrahedral coordination of at least about 10:1.

4. A packaging material according to claim 1, wherein the zeolite is a pentasil.

5. A packaging material according to claim 1, wherein said material contains zeolite in an amount of from about 0.05 kg/ton up to about 20 kg/ton of dry material.

6. A packaging material according to claim 1, wherein said material contains a retention agent.

7. A packaging material according to claim 1, wherein the hydrophobicity of the zeolite lies in the range of from 0.0001 up to 0.5 percent by weight residual butanol as determined by the Residual Butanol Test.

8. A packaging material according to claim 1, wherein said material contains zeolite in an amount of from about 0.05 kg/ton up to 10 kg/ton of dry material.

9. A packaging material according to claim 1, wherein said packaging material comprises paper or board for solid or liquid foodstuff, tobacco or medicines.

10. A packaging material for forming a package having reduced transfer to the package contents of at least one of substances causing undesirable taste or hazardous substances, wherein said packaging material includes a hydrophobic zeolite selected from the group consisting of ZSM-5, ZSM-11, ZSM-8, ZETA-1, ZETA-3, NU-4, NU-5, ZBM-10, TRS, MB-28, Ultrazet, TsVKs, TZ-01, TZ-02 and AZ-1, and mixtures thereof, said zeolite having a particle size less than about 20 μm and having a hydrophobicity of below about 0.6 percent by weight residual butanol as determined by the Residual Butanol Test.

11. A packaged article comprising (a) an article including a member that is a solid or liquid foodstuff, water, tobacco, or a medicine and (b) a packaging material formed over the article and including an additive comprising a hydrophobic zeolite having a particle size of less than about 20 μm and a hydrophobicity of below about 0.6% by weight residual butanol as measured by the Residual Butanol Test and present in the packaging material in an amount sufficient to reduce the transfer from the packaging material to the article of at least one of a substance causing undesirable taste or a hazardous substance, as compared to an identical packaging material not containing the additive.

12. A packaged article according to claim 11 wherein the packaging material further includes a retention agent.

13. A packaged article according to claim 11 wherein the packaging material comprises paperboard.

14. A packaged article according to claim 13 wherein the article further includes at least one outer layer of plastic.

* * * * *